US006664521B1

(12) United States Patent
Kondo et al.

(10) Patent No.: US 6,664,521 B1
(45) Date of Patent: Dec. 16, 2003

(54) LINE SWITCH PART SNOW MELTING DEVICE

(75) Inventors: Shinji Kondo, Toyonaka (JP); Youji Uetani, Amagasaki (JP); Yoshiki Hama, Nishinomiya (JP); Jun Iguchi, Kato-gun (JP); Harumi Tasaki, Osaka (JP); Atsushi Fujisawa, Osaka (JP); Sadatsugu Higashide, Osaka (JP)

(73) Assignees: Matsushita Electric Industrial Co., Ltd., Osaka (JP); West Japan Railway Company, Osaka (JP); West Japan Railway Technos Corporation, Osaka (JP)

( * ) Notice: Subject to any disclaimer, the term of this patent is extended or adjusted under 35 U.S.C. 154(b) by 0 days.

(21) Appl. No.: 10/111,198

(22) PCT Filed: Oct. 19, 2000

(86) PCT No.: PCT/JP00/07303

§ 371 (c)(1),
(2), (4) Date: Aug. 7, 2002

(87) PCT Pub. No.: WO01/29318

PCT Pub. Date: Apr. 26, 2001

(30) Foreign Application Priority Data

Oct. 19, 1999 (JP) ..... 11-296159

(51) Int. Cl.[7] ..... H05B 6/10
(52) U.S. Cl. ..... 219/635; 219/639
(58) Field of Search ..... 219/635, 639, 219/672, 676, 646, 658, 656, 213; 37/199, 200; 104/279, 280; 246/428

(56) References Cited

U.S. PATENT DOCUMENTS

| | | | | |
|---|---|---|---|---|
| 4,051,466 A | * | 9/1977 | Protze | 340/601 |
| 4,429,845 A | * | 2/1984 | Stover et al. | 246/428 |
| 5,389,766 A | * | 2/1995 | Takahashi et al. | 219/635 |

FOREIGN PATENT DOCUMENTS

| | | |
|---|---|---|
| JP | 10-2800 | 3/1935 |
| JP | 10-266101 | 10/1998 |

* cited by examiner

*Primary Examiner*—Quang T. Van
(74) *Attorney, Agent, or Firm*—Jordan and Hamburg LLP

(57) ABSTRACT

A thawing device for railway track points is constituted by connecting a heating coil (1*a*) wound around a floor plate (2) for heating the floor plate (2) by induction to an inverter device (5) for supplying high-frequency current to the heating coil (1*a*), via a connection cable (4); and providing a protection against magnetism (9, 10*a*–10*c*, 11*a*–11*c* , 12*a*, 12*b*) about the periphery of the heating coil (1*a*) and the connection cable (4).

11 Claims, 11 Drawing Sheets

1a
1c
2
3
4
5
6
7
8

1a
1c
2
3
4
5
6
7
8

1a
2
3
4
5
6
7
8
9
MC

LINE SWITCH PART SNOW MELTING DEVICE

TECHNICAL FIELD

The present invention relates to a thawing device for railway track points for preventing failures in points changing due to snow or icing at the points sections of railway tracks.

BACKGROUND ART

Conventional types of thawing device for railway track points include, as a device for use in regions having large amounts of snow, a hot air blower type of thawing device, wherein kerosene or the like is burnt and hot air generated thereby is blown via a duct onto the points sections. Furthermore, as a device for use in regions having small amounts of snow, there is an electric heater type thawing device, wherein electric heaters are placed on the main rails and the side regions of floor plates, thereby heating the points sections.

However, these conventional thawing devices have following problems% in the case of the hot air blower type of thawing device, although the thawing capacity is excellent, there have been problems in that the heating efficiency is poor and hence fuel expenses are high, there is a risk of accidental fire, and disassembly and maintenance must be carried out in the season when the device is out of use. In the case of the electric heater type thawing device, there have been problems in that the thawing capacity is low, the rate of temperature increase is show, and ease of installation is poor, given that a special floor plate is used, and the like.

In order to increase the heating efficiency, it may be considered to use high-frequency current, but this brings a risk that the magnetic flux created by the high-frequency current may affect other devices.

Consequently, an object of the present invention is to provide a thawing device for railway track points sections which solves the above-mentioned problems by lowering running costs by means of highly efficient heating, and which secures safety by reducing the effects on other devices of the magnetic flux caused by the high-frequency current.

DISCLOSURE OF THE INVENTION

A thawing device for railway track points according to a first aspect of the present invention is characterized by including: a heating coil wound around a floor plate for heating the floor plate by induction; and an inverter device for supplying high-frequency current to the heating coil. By adopting this construction, the heating coil is wound around the floor plate and the heating surface area is increased, and hence the floor plate is heated at high-power with a high-frequency current, and a good effect in preventing ice formation on the floor plate and/or rails is obtained by thermal conduction from the floor plate to a main rail and tongue rails. Moreover, since the heating coil does not project significantly beyond a sleeper, it does not obstruct track maintenance work, and does not require detachment outside of the snow season.

In the aforementioned construction, it is preferred that the heating coil is wound through one or more turns in contact with the side face or the lower face of the floor plate. Thereby, the heating surface area is increased further, floor plate induction heating is performed at high-power, and a highly effective thawing capacity is achieved.

Further, it is preferred that a portion of the heating coil is wound in contact with the upper face of the floor plate. Thereby, the heating coil can be wound around the floor plate even in cases where the floor plates of the left and right-hand rails are connected, for example, at the front end portion of a railway points, or in cases where the floor plate is long.

A thawing device for railway track points according to a second aspect of the invention is characterized by including:

a heating coil wound around a floor plate for heating the floor plate by induction; an inverter device for supplying high-frequency current to the heating coil; and a protection against coil magnetism for preventing magnetic flux of the heating coil from leaking. By adopting this construction, leakage of magnetic flux from the high-frequency magnetic field generated by the heating coil is reduced, thereby reducing the effects of high-frequency noise on other devices.

In the aforementioned construction, it is preferred that the protection against coil magnetism is constituted by a cover made of a material having high resistivity and high magnetic permeability, which covers the periphery of the heating coil wound around the floor plate. Thereby, leakage of magnetic flux of the heating coil is prevented, and the effects of high-frequency noise on other devices is reduced, whilst at the same time suppressing any heating by induction of the coil magnetism prevention means itself, due to the magnetic flux.

Alternatively, the protection against coil magnetism may be constituted by first closed loop conductors disposed about the outer circumference of a single heating coil or a plurality of heating coils wound around the floor plates, and second closed loop conductors disposed around the periphery of the first closed loop conductors. Thereby, an eddy current which cancels out magnetic flux leaking from the first closed loop is induced in the second closed loop conductors, and the area peripheral to the heating coils is protected against magnetism, and the effects of high-frequency noise on other devices are reduced.

A thawing device for railway track points according to a third aspect of the invention is characterized in that a plurality of heating coils wound around floor plates for heating the floor plates by induction are connected in series by means of a feeder cable, these heating coils are connected by means of connection cables with a single inverter device for supplying high-frequency current to the heating coils, and a protection against cable magnetism is provided for preventing magnetic flux of the cables from leaking. By adopting this construction leakage of high-frequency magnetic flux generated by the cables is reduced, thereby reducing the effects of high-frequency noise on other devices.

In the aforementioned construction, it is preferred that the protection against cable magnetism is constituted by twisting the supply or return connection cables from the inverter device to the heating coils, and the feeder cable. Thereby, the magnetic fluxes induced by the high-frequency current in the supply and return cables cancel out mutually, and the area peripheral to the cables is protected against magnetism and the effects of high-frequency noise on other devices are reduced.

Alternatively, the protection against cable magnetism ay be constituted by covers which cover the periphery of the supply and return connection cables from the inverter device to the heating coils,-and the feeder cable, and which are connected in a closed loop in the vicinity of the heating coils and the inverter device. Thereby, an eddy current which cancels out magnetic flux inside the closed loop having leaked from the connection cables is induced in the covers of the closed loop, and the area peripheral to the cables is protected against magnetism and the effects of high-frequency noise on other devices are reduced.

Alternatively, the protection against cable magnetism may be constituted by superposing coils wherein portions of the supply and return connection cables are wound respectively in the same direction, to the same diameter, and through the same number of turns. Thereby, the magnetic fluxes induced by the high-frequency current in the supply and return connection cables cancel out mutually, and the area peripheral to the cables is protected against magnetism and the effects of high-frequency noise on other devices are reduced.

A thawing device for railway track points according to a fourth aspect of the Invention is characterized by including:

a heating coil for heating a floor plate by induction; an inverter device for supplying high-frequency current to the heating coil; a train detecting device for detecting the approach of a train to a points section; and an inverter controller for outputting a signal to the inverter device, the signal for either reducing or interrupting the supply of high-frequency current to the heating coil for a prescribed period of time after the approach of a train has been detected by the train detecting device. By adopting this construction, the supply of high-frequency current from the inverter device to the heating coil is either reduced or interrupted for a prescribed period of time after the approach of a train is detected. Thereby, the effects of the high-frequency noise on the high-precision equipment of the train are reduced, when the train is passing over the points section.

In the aforementioned construction, it is preferred that the train detecting device includes a magnetic field detector for converting an electrical signal into a magnetic flux and detecting changes in magnetic field caused by the approach of a train. In the magnetic flux generated by the coil or the like of the magnetic field detector, the magnetic resistance will change if a portion of a trains namely, a train wheel, is present. By detecting the changes in impedance and changes in signal current corresponding to this change, the approach of a train is detected, whereupon, for a prescribed period of time, the supply of high-frequency current to the heating coil is reduced or interrupted, thereby reducing the effects of high-frequency noise on the high-precision equipment of a train when the train is passing over a points section.

Alternatively, the train detecting device may be constituted by a signal transmitter for inputting a track path signal indicating whether a short circuit is caused between the left and right-hand rails by an axle of a train within a prescribed sections and transmitting a train present/absent signal; and a signal receiver for receiving the transmitted train present/absent signal. When a train enters the prescribed section and the left and right-hand rails are shorted by the train axle, a train present signal is output from the signal transmitter to the signal receiver, whereby the train detecting device detects that a train is passing through, or is halted in, the points section. Whereupon, the supply of high-frequency current to the heating coil is reduced or interrupted for a prescribed period of time, and hence the effects of high-frequency noise on the high-precision equipment of a train is reduced when the train is passing through a points section.

BRIEF DESCRIPTION OF THE DRAWINGS

FIG. 1A is a front view and FIG. 1B is a plan view;

FIG. 2A is a front view and FIG. 2B is a plan view;

FIG. 3A is a front view and FIG. 3B is a plan view;

FIG. 4A is a front view, FIG. 4B is a plan view, and FIG. 4C is an enlarged sectional view of the portion indicated by IVC in FIG. 4B;

FIG. 9 FIG. 9C show a thawing device for railway track points according to a ninth embodiment of the invention: FIG. 9C is an illustrative diagram of the railway tracks;

FIG. 10A is a front view and FIG. 103 is a detailed view of the portion indicated by XB in FIG. 10A.

BEST MODE FOR CARRYING OUT THE INVENTION

Preferred embodiments of the invention will be described below with reference to FIG. 1A to FIG. 11.

(First Embodiment)

Figures 1A, 1B:
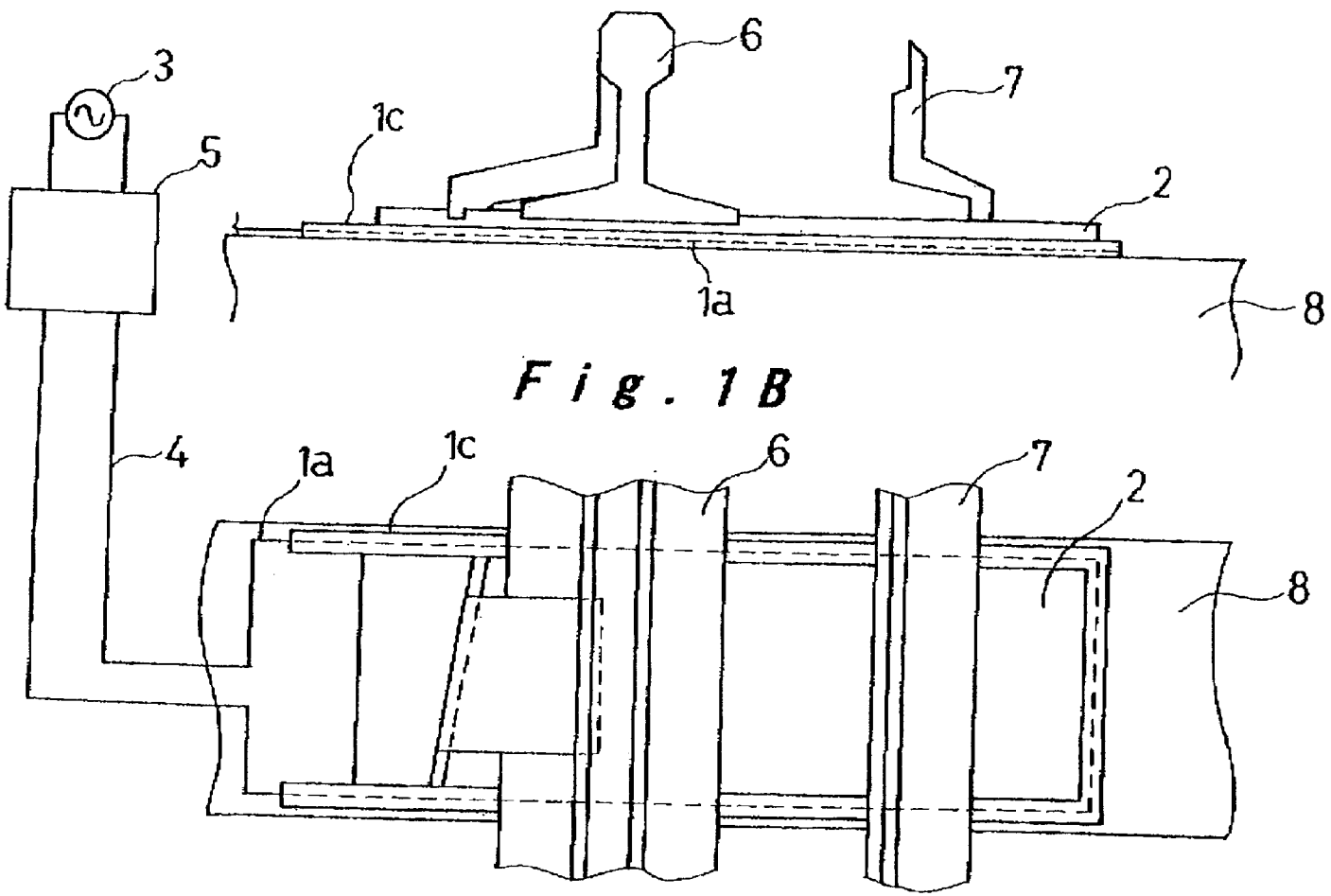
FIG. 1A and FIG. 1B show a thawing device for railway track points according to a first embodiment of the present invention.

A thawing device for railway track points according to a first embodiment of the present invention is described with reference to FIGS. 1A and 1B. Numeral 1*a* denotes a heating coil which is wound along the side face of a floor plate 2 and accommodated inside a heating coil case 1*c*. The heating coil 1*a* is connected by a connection cable 4 to an inverter device 5 which supplies high-frequency current from a commercial power source 3. When a high-frequency current is supplied to the heating coil 1*a*, a high-frequency magnetic field is generated therein, and the floor plate 2 is induction heated by this high-frequency magnetic field. Heat generated in the floor plate 2 is transferred to a main rail 6 and a tongue rail 7, thereby raising the temperature of these rails 6 and 7, consequently, any snow or ice present on the floor plate 2 or rails 6 and 7 is caused to melt, and hence points changing failures are prevented. Furthermore, since the heating coil 1*a* is wound once or more times around the side face of the floor plate 2, induction heating is performed at high-power, and a good effect in preventing ice formation is achieved by thermal conduction to the rails 6 and 7. Additionally, since the heating coil 1*a* does not project significantly beyond a railway sleeper 8, it does not interfere with track maintenance tasks such as ballast packing or the like, and does not need to be removed outside of the snow season.

(Second Embodiment)

Figures 2A, 2B:
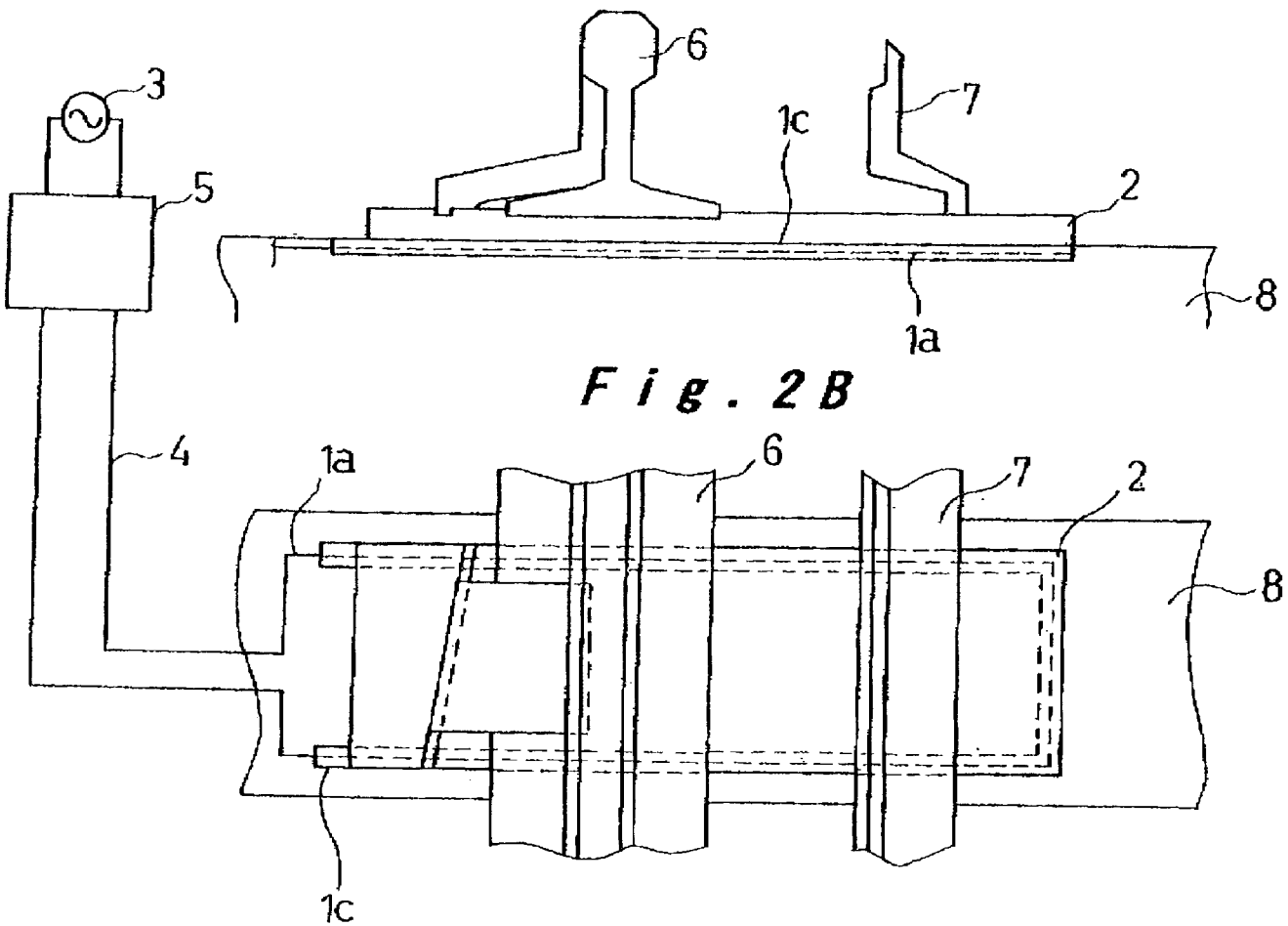
FIG. 2A and FIG. 2B show a thawing device for railway track points according to a second embodiment of the invention.

A second embodiment of the present invention is described with reference to FIGS. 2A and 2B. In this embodiment, the thawing device for railway track points is constituted by winding the heating coil 1*a* accommodated in the heating coil casing 1*c*, one or more times in contact with the lower face of the floor plate 2. Besides this, the construction is the same as that in the first embodiment, and high-frequency current is supplied to the heating coil 1*a* from the commercial power source 3, via the inverter device 5. The heating coil 1*a* generates a high-frequency magnetic field due to the high-frequency current supplied thereto, and the floor plate 2 is induction heated by the magnetic field. Heat generated in the floor plate 2 is transferred to the main rail 6 and tongue rail 7, thereby raising the temperature of these rails 6 and 7. Consequently, any snow or ice present on the floor plate 2 or the rails 6 and 7 is caused to melt, thereby preventing points changing failures. Furthermore, since the heating coil 1*a* is wound one or more times in contact with the lower face of the floor plate 2, induction heating is performed at high-power, and a good effect in preventing ice formation is achieved by thermal conduction to the rails 6 and 7. Additionally, since the heating coil 1*a* does not project significantly beyond the railway sleeper 8, it does not interfere with track maintenance tasks such as ballast packing or the like, and does not need to be removed outside of the snow season.

(Third Embodiment)

Figures 3A, 3B:
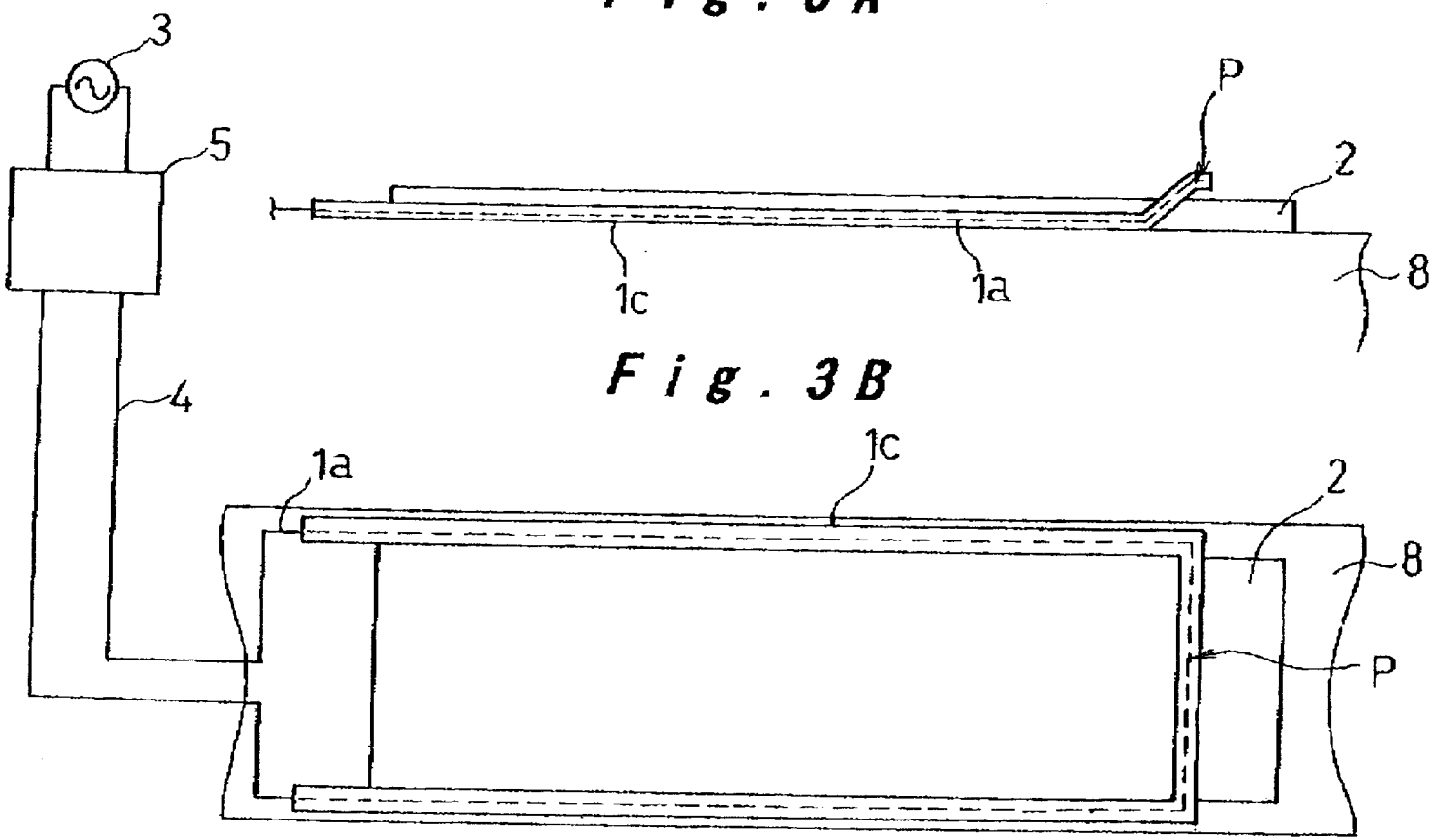
FIG. 3A and FIG. 3B show a mode of installation of a thawing device for railway track points according to a third embodiment of the invention.

A third embodiment of the present invention is described with reference to FIGS. 3A and 3B. In this embodiment, the thawing device for railway track points is constituted ouch that the heating coil 1*a* is wound along the side face of the floor plate 2, but at a position which does not interfere with the opening and closing operation of the tongue rail 7, a portion P of the heating coil 1*a* is wound in contact with the upper surface of the floor plate 2. By adopting this construction, it is possible to wind the heating coil 1*a* around the floor plate 2, even in cases where the floor plates 2 of the left and right-hand rails 7 are connected at the front end portion of a railway track points section, or where the floor plate 2 is long.

(Fourth Embodiment)

Figures 4A, 4B, 4C:
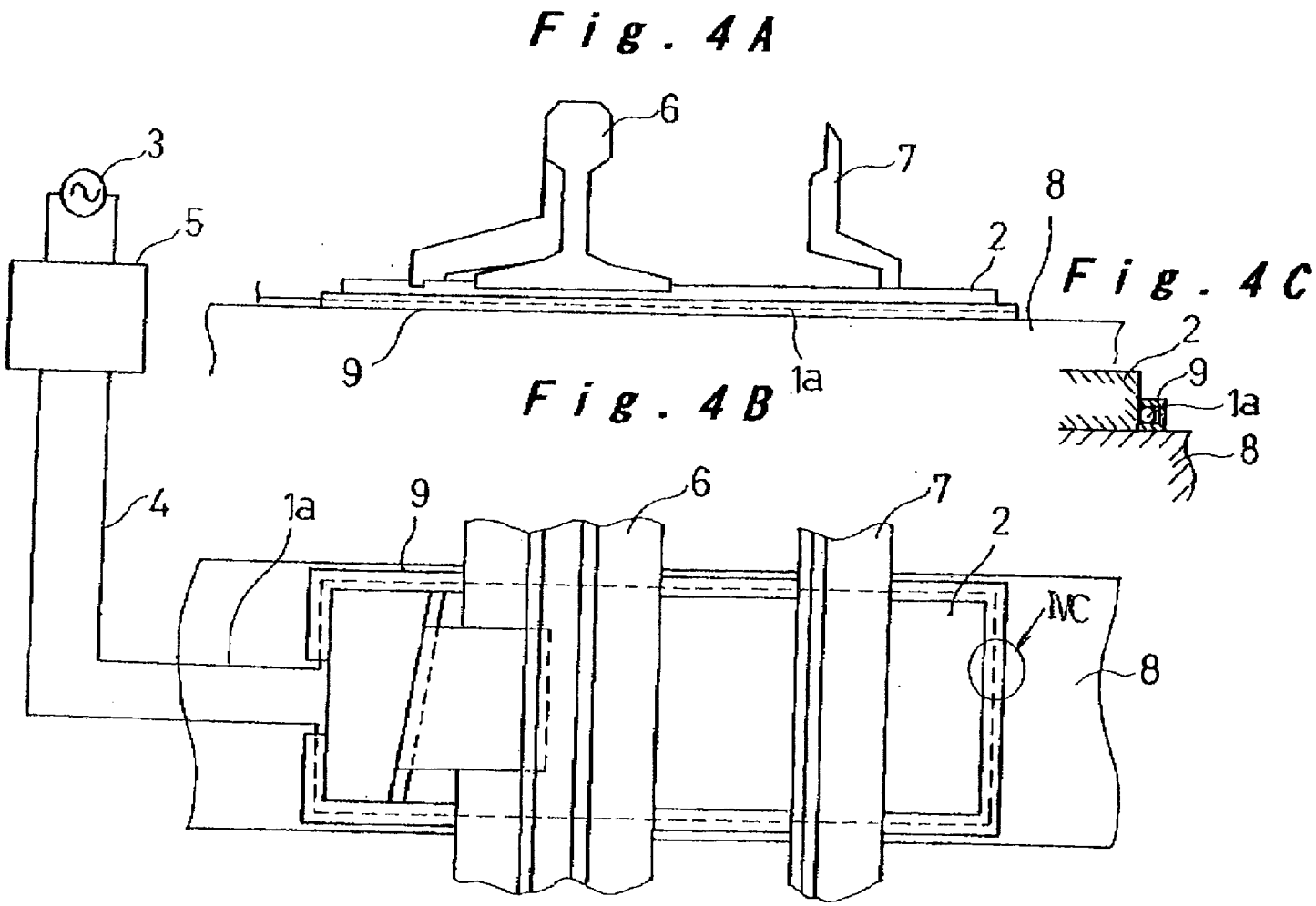
FIG. 4A to FIG. 4C show a thawing device for railway track points according to a fourth embodiment of the invention.

A fourth embodiment of the present invention is described with reference to FIGS. 4A to 4C. In this embodiment, the periphery of the heating coil 1*a* wound along the side face of the floor plate 2 is covered by a protection against coil magnetism 9, which prevents the magnetic flux of the heating coil 1*a* from leaking. The protection against coil magnetism 9 is made from a material having high resistivity and high magnetic permeability, such as ferrite, and forms a closed magnetic circuit with the side face of the floor plate 2, whereby leakage of magnetic flux from the high-frequency magnetic field generated in the heating coil 1*a* is reduced, and induction heating of the protection against coil magnetism 9 itself is suppressed. Besides this, the basic construction is similar to that of the various embodiments described above, heat generated in the floor plate 2 being transferred to the main rail 6 and tongue rail 7, thereby causing snow or ice present on the floor plate 2 or rails 6 and 7 to melt and hence preventing failures in points changing.

Figure 5:
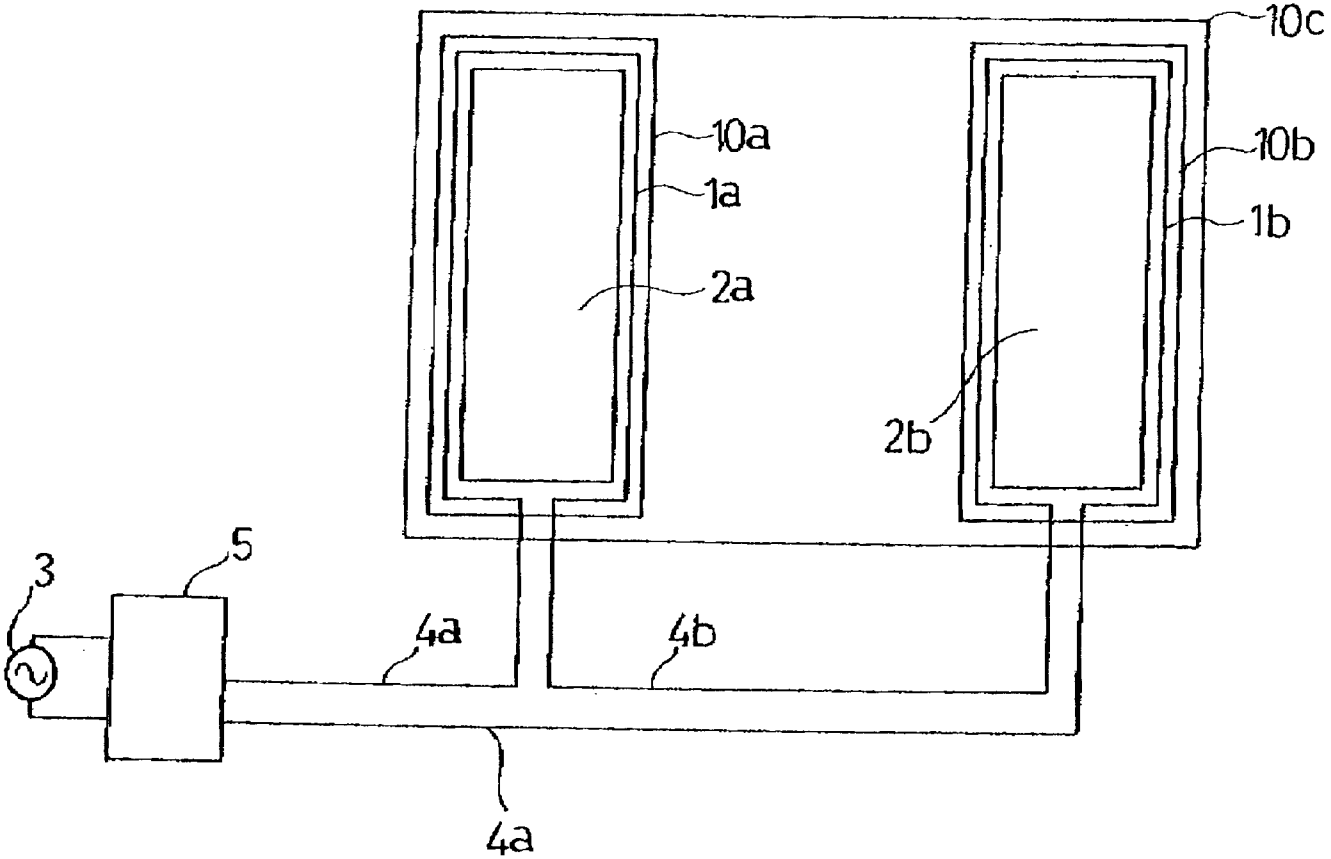
FIG. 5. is a diagram illustrating a thawing device for railway track points according to a fifth embodiment to the invention.

(Fifth Embodiment),

A fifth embodiment of the invention is described with reference to FIG. 5. In this embodiment, a first closed loop conductor 10*a* is disposed about the outer circumference of a first heating coil 1*a* positioned about the periphery of a first floor plate 2*a*, a second closed loop conductor 10*b* is disposed about the outer circumference of a second heating coil 1*b* positioned about the periphery of a second floor plate 2*b*, and a third closed loop conductor 10*c* is disposed about the outer circumferences of these two closed loop conductors 10*a* and 10*b*, a protection against coil magnetism being constituted by these conductors 10*a*, 10*b*, and 10*c*. By adopting this construction, an eddy current is induced in the third closed loop conductor 10*c* so as to cancel out any magnetic flux in the first and second closed loop conductors 1*a* and 10*b* which has leaked from the first and second heating coils 1*a* and 1*b*, and therefore magnetic flux of the heating coils 1*a* and 1*b* is prevented from leaking. Incidentally, numeral 4*a* in FIG. 5 denotes a connection cable which connects the heating coils 1*a* and 1*b* to the inverter device 5, and numeral 4*b* is a feeder cable.

(Sixth Embodiment)

Figure 6:
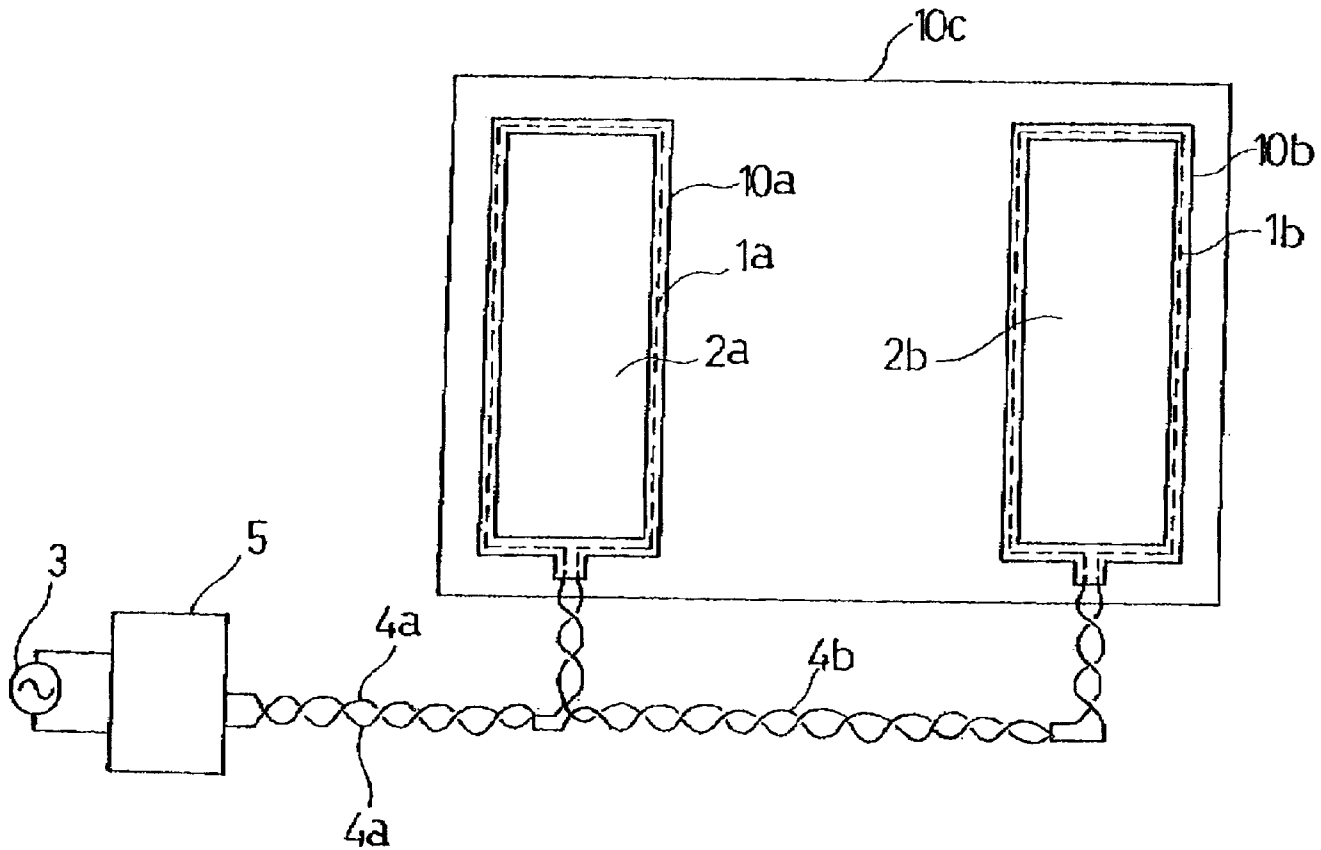
FIG. 6 is a diagram illustrating a thawing device for railway track points according to a sixth embodiment of the invention.

A sixth embodiment of the invention is described with reference to FIG. 6. In this embodiment, similarly to the fifth embodiment, a protection against coil magnetism is constituted by respectively disposing conductors 10*a* to 10*c* about the circumferences of the heating coils 1*a* and 1*b* wound respectively around the floor plates 2*a* and 2*b*, in addition to which a protection against magnetism is also provided for the cables. More specifically, the heating coils 1*a* and 1*b* are connected in series by means of the feeder cable 4*b*, and furthermore, a protection against cable magnetism is constituted by twisting the supply connection cable and the return connection cable 4*a* and 4*a*, and also the feeder cable 4*b*, along which the high-frequency current passes. By adopting this construction, the high-frequency current flows in opposite directions in the supply and return cables, and the high-frequency magnetic fields generated in the twisted connection cables 4*a* and 4*a* also act in opposite directions, thereby cancelling each other out, and hence preventing leakage of magnetic flux of the cables.

(Seventh Embodiment)

Figure 7:
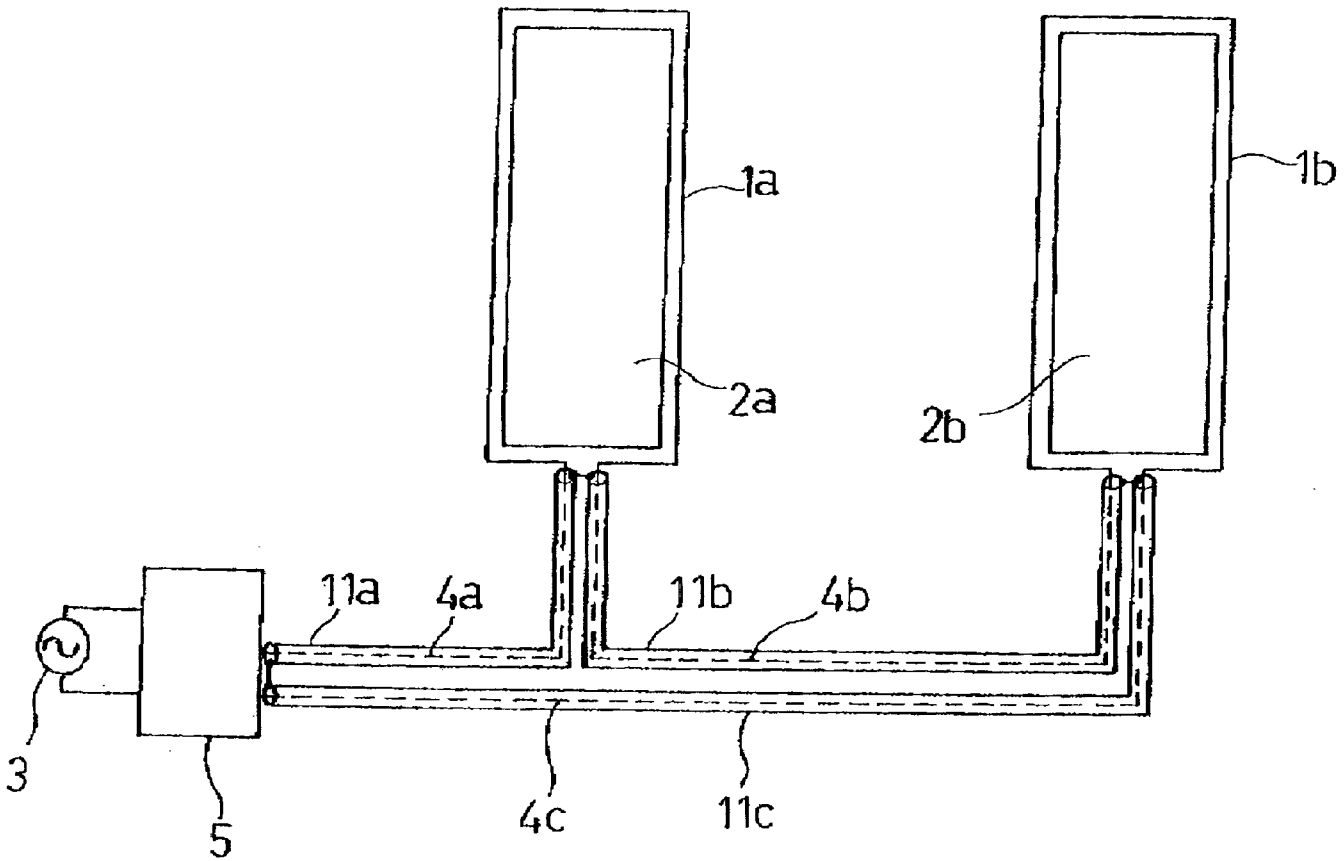
FIG. 7 is a diagram illustrating a thawing device for railway track points according to a seventh embodiment of the invention.

A seventh embodiment of the invention is described with reference to FIG. 7. In this embodiment, the heating coils la and 1*b* wound respectively along the floor plates 2*a* and 2*b* are connected in series via the feeder cable 4*b* and two connection cables 4*a* and 4*c*, to the single inverter device 5. A protection against cable magnetism is constituted by covering these three cables 4*a*, 4*b*, and 4*c* by means of shields (cable magnetism-proof covers) 11*a*, 11*b*, and 11*c*. The shields 11*a*, 11*b*, and 11*c* are connected at three locations in the vicinity of the heating coils 1*a* and 1*b* and in the vicinity of the inverter device 5, in such a manner that they form a closed loop. By adopting this construction, an eddy current is induced in the shields 11*a*, 11*b*, and 11*c* forming the closed loop which cancels out any magnetic flux inside the closed loop having leaked from the cables 4*a*, 4*b*, and 4*c*, thereby preventing magnetic flux of the cables from leaking.

(Eighth Embodiment)

Figure 8:
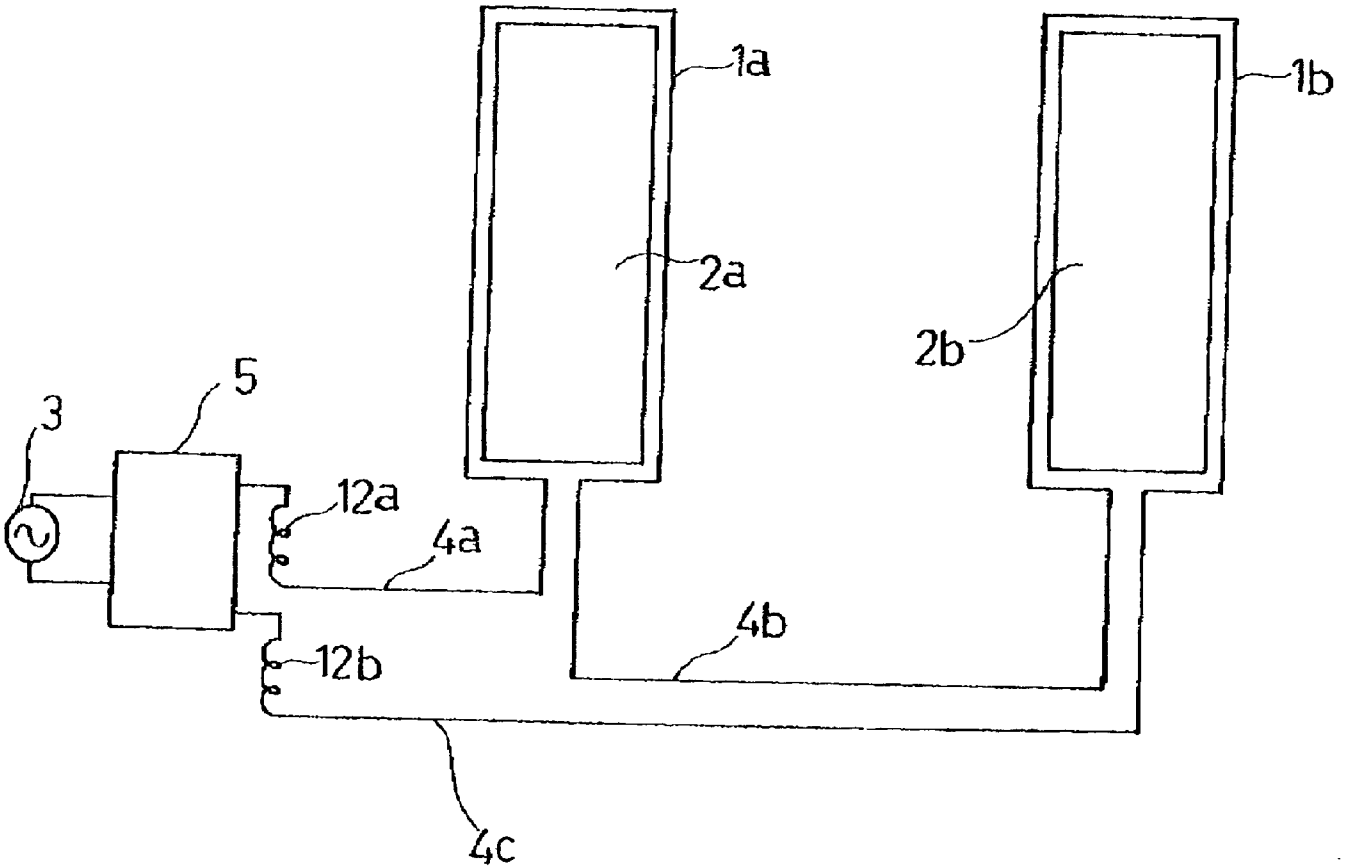
FIG. 8 is a diagram illustrating a thawing device for railway track points according to an eighth embodiment of the invention.

An eighth embodiment of the invention is described with reference to FIG. 8. In this embodiment, the heating coils 1*a* and 1*b* wound respectively along the floor plates 2*a* and 2*b* are connected in series by means of the feeder cable 4*b* and two connection cables 4*a* and 4*c*, to the single inverter device 5. A protection against cable magnetism is constituted by superposing two coils 12*a* and 12*b* which are formed by winding respective portions of the two connection cables 4*a* and 4*c* in the same direction, to the same diameter, and by the same number of turns. By adopting this construction, the magnetic fluxes induced by the high-frequency current in the supply and return connection cables cancel each other out, thereby preventing magnetic flux of the cables from leaking.

(Ninth Embodiment)

Figure 9A:
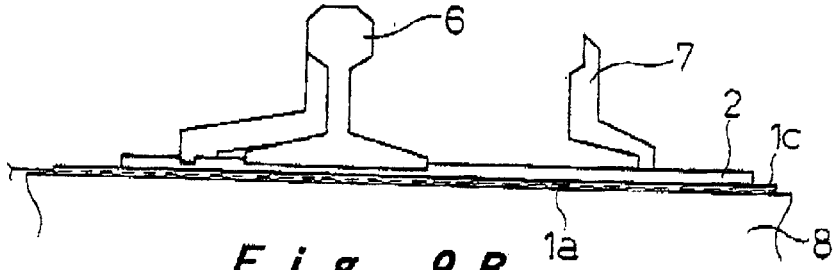
FIG. 9A is a front view.
Figure 9B:
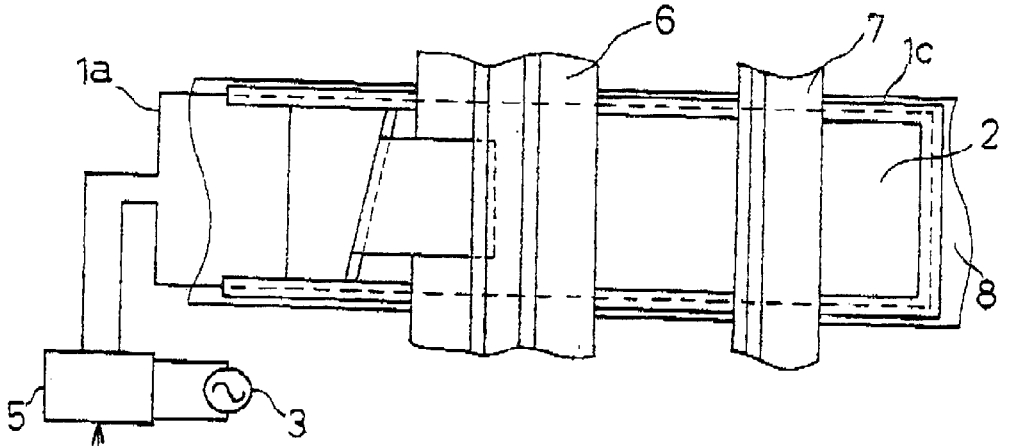
FIG. 9B is a plan view.
Figure 9B:
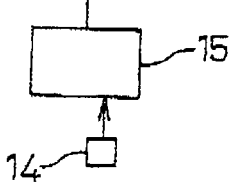
Figure 9C:
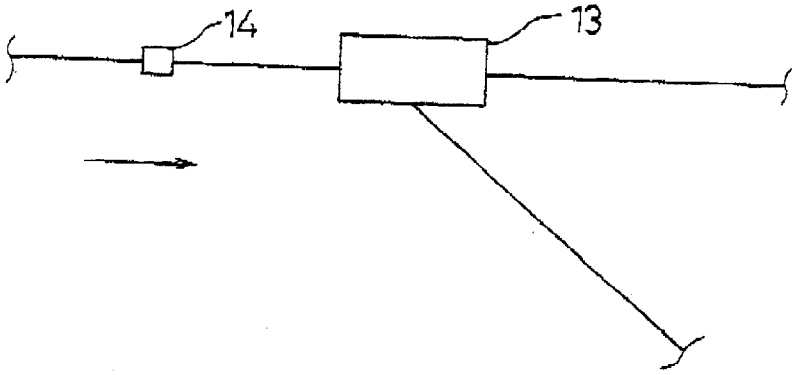

A ninth embodiment of the invention is described with reference to FIGS. 9A to 9C. In this embodiment, similarly to the first embodiment, a high-frequency current is supplied by the inverter device 5 to the heating coil 1*a* (numeral 1*c* indicates the casing inside which the coil is accommodated) wound around the side face of the floor plate 2, and the floor plate 2 is induction heated by means of the high-frequency magnetic field generated by the high-frequency current. Furthermore, a train detecting device 14 is disposed in front of a points section 13 in the direction of travel of the trains, as indicated by the arrow in FIG. 9C, and is connected via an inverter controller 15 to the inverter device 5. The inverter controller 15 inputs an approach signal when a train has approached the points section 13, and after detecting this as an approach signal, for a prescribed period of time, it outputs a signal to the inverter device 5 whereby the supply of high-frequency current to the heating coil 1*a* is reduced or halted. By adopting this construction, when a train passes over the points section 13, the effect of the high-frequency noise generated in the points section 13 on the high-precision equipment of the train is reduced.

(Tenth Embodiment)

Figure 10A:
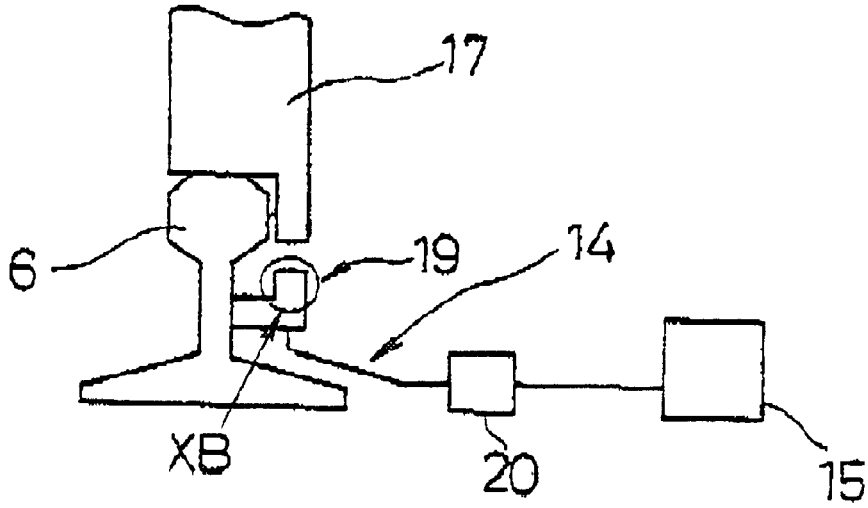
FIG. 10A and FIG. 10B show a thawing device for railway track points according to a tenth embodiment of the invention.
Figure 10B:
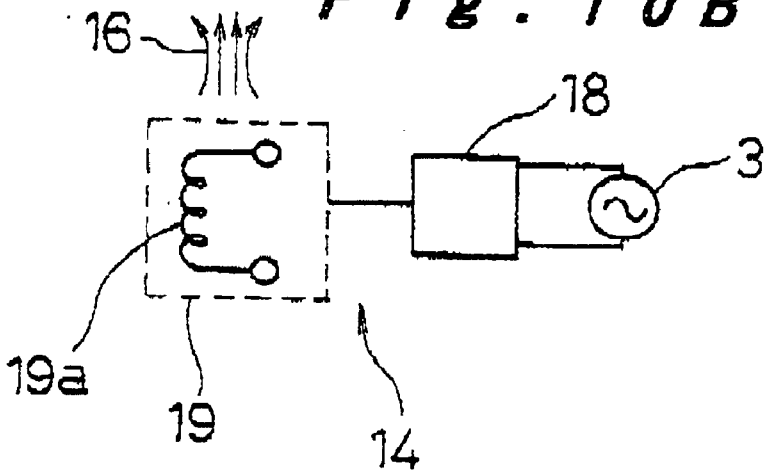

A tenth embodiment of the invention is described with reference to FIGS. 10A and 10B. In this embodiment, the train detecting device 14 as described in the ninth embodiment is disposed on the central portion of the main rail 6. The train detecting device 14 is constituted by a signal generator 18 for generating a signal from the commercial power source 3, a magnetic field detector 19 for converting an electrical signal to a magnetic flux, and an amplifier 20 for amplifying the signal. For the aforementioned magnetic field detector 19, a coil 19*a* generating a magnetic field is used. When a portion of a train wheel 17 approaches, the magnetic resistance of the magnetic flux 16 produced by the coil 19*a* changes, and accordingly, the impedance of the coil 19*a* changes. If the train detecting device 14 detects the approach of a train due to a change in impedance, then the signal generator 18 generates a signal and said signal is transmitted to the inverter controller 15 via the amplifier 20. According to the train detecting device 14 of the present embodiment, the presence or absence of a train is detected by means of a change in the impedance of the coil 19*a* and a change in the signal current, due to change in the magnetic field according to whether or not a train is present. Thus, when a train passes over the points section, the effect of the high-frequency noise generated at the points section on the high-precision equipment of the train is reduced, by either reducing or interrupting the supply of high-frequency current to the heating coil 1*a*.

(Eleventh Embodiment)

Figure 11:
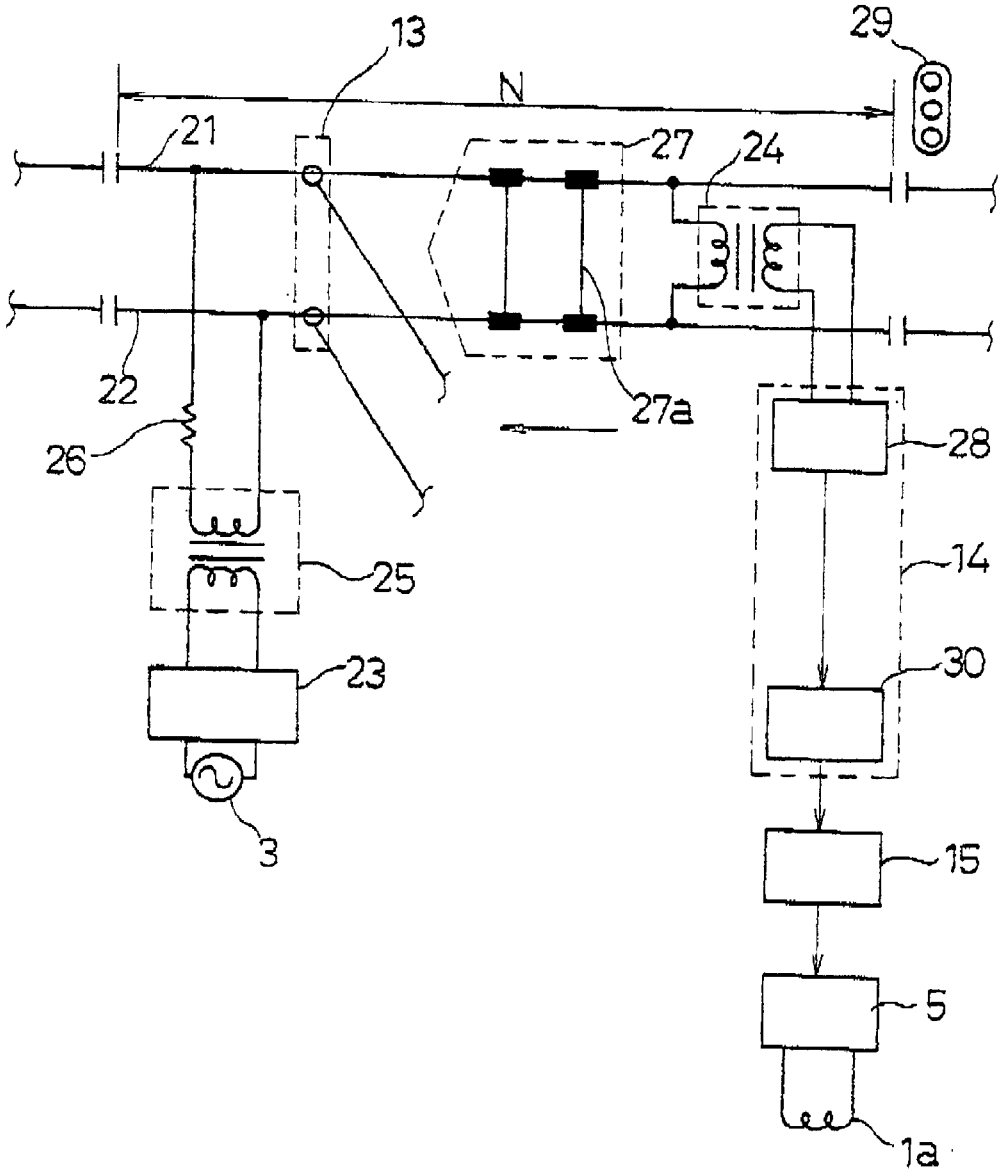
FIG. 11 is a diagram showing a thawing device for railway track points according to an eleventh embodiment of the invention.

An eleventh embodiment of the invention is described with reference to FIG. 11. In this embodiment, the thawing device for railway track points has the same basic construction as that in the first to eighth embodiments, and further includes the train detecting device 14 provided in front of the points section 13 in the direction of travel of the trains, as indicated by the arrow in the Figure. More specifically, in a specific section N comprising a prescribed distance of the railway track, a transit path circuit is formed by the right and left rails 21 and 22, and a signal generator 23 supplies an excitation signal from the commercial power source 3 to a transit path relay 24, by means of a transit path transformer 25 and a resistor 26, when a train 27 enters inside the specific section N and the left and right rails 21 and 22 are shorted by a train axle 27*a*, the excitation signal supplied to the transit path relay 24 is reduced. A signal transmitter 28 is connected to the transit path relay 24, a signal device 29 and a signal receiver 30, and if it is judged from a change in the excitation signal supplied to the transit path relay 24 that the train 27 is present inside the specific section N, then the signal device 29 automatically operates and outputs a train present signal to the signal receiver 30. In this embodiment, the train detecting device 14 is constituted by the signal receiver 30 and the signal transmitter 28. The inverter controller 15 is connected to the train detecting device 14 and if it is judged that the train 27 is passing through, or has halted in the points section 13 within the specified section N, then the controller outputs a signal to the inverter device 5 whereby the supply of high-frequency current to the heating coil 1*a* is either reduced or interrupted. By adopting this construction, the effect of high-frequency noise generated in the points section 13 on the high-precision equipment of the train is reduced.

INDUSTRIAL APPLICABILITY

According to the present invention, there is provided a thawing device for railway track points which has a good effect in preventing ice formation on floor plates, main rails and tongue rails, by high-power induction heating using high-frequency electric current, and which, furthermore, does not require removal outside of the snow season.

Moreover, by providing a protection against coil magnetism and a protection against cable magnetism, leakage of high-frequency magnetic flux generated in the heating coils and cables is reduced, thereby reducing the effect of high-frequency noise on other devices.

Furthermore, by providing a train detecting device, and implementing control by an inverter controller whereby the supply of high-frequency current from the inverter device to the heating coil is reduced or interrupted for a prescribed period of time after the approach of a train has been detected, the effect of high-frequency noise generated in the points section on the high-precision equipment of the trains is reduced. Therefore, the thawing device for railway track points according to the present invention is beneficial in that it achieves heating of high efficiency by using high-frequency current, whilst also securing safety by suppressing the effects of the magnetic flux caused by the high-frequency current on other devices and on the high-precision equipment of the trains.

What is claimed is:

1. A thawing device for railway track points, comprising:

a heating coil (1*a*) for heating a floor plate (2) by induction;

an inverter device (5) for supplying high-frequency current to the heating coil (1*a*);

a train detecting device (14) for detecting the approach of a train to a points section (13); and an inverter controller (15) for outputting a signal, to the inverter device (5), the signal for either reducing or interrupting the supply of high-frequency current to the heating coil (1*a*) for a prescribed period of time after the approach of a train has been detected by said train detecting device (14).

2. The thawing device for railway track points according to claim 1, wherein said train detecting device (14) comprises a magnetic field detector (19) for converting an electrical signal into a magnetic flux and detecting changes in magnetic field caused by the approach of a train.

3. The thawing device for railway track points according to claim 1, wherein said train detecting device (14) is constituted by a signal transmitter (28) for inputting a track signal indicating whether short circuit is caused between left and right-hand rails (21, 22) by an axle (27*a*) of a train (27) within a prescribed section, and transmitting a train present/absent signal; and a signal receiver (30) for receiving the train present/absent signal.

4. A thawing device for railway track points, comprising:

a heating coil for heating a floor plate by inducting; and an inverter device for supplying high-frequency current to the heating coil, wherein, the heating coil is wound through one or more turns in contact with the lower face of the floor plate.

5. A thawing device for railway track points, comprising:

a heating coil for heating a floor plate by induction; and an inverter device for supplying high-frequency current to the heating coil, wherein the heating coil is wound in contact with the side face of the floor plate and a portion thereof is wound in contact with the upper face of the floor plate.

6. A thawing device for railway track points, comprising:

a heating coil wound around a floor plate for heating said floor plate by induction;

an inverter device for supplying high-frequency current to the heating coil; and a protection against coil magnetism for preventing magnetic flux of the heating coil from leaking, wherein the protection against coil magnetism is constituted by closed loop conductors disposed about the periphery of the heating coil.

7. A thawing device for railway track points, comprising:

a plurality of heating coils wound around floor plates for heating the floor plates by induction;

an inverter device for supplying high-frequency current to the heating coils;

a feeder cable for connecting the heating coils in series;

a supply and return connection cable for connecting the heating coils and the inverter device; and a protection against cable magnetism for preventing magnetic flux of the cables from leaking, wherein said protection against cable magnetism is constituted by twisting the supply and return connection cables and the feeder cable.

8. A thawing device for railway track points, comprising:

a plurality of heating coils wound around floor plates for heating the floor plates by induction;

an inverter device for supplying high-frequency current to the heating coils;

a feeder cable for connecting the heating coils in series;

a supply and return connection cable for connecting the heating coils and the inverter device; and a protection against cable magnetism for preventing magnetic flux of the cables from leaking, wherein said protection against cable magnetism is constituted by cable magnetism-proof covers for covering the supply and return connection cables and the feeder cable, the covers being connected in a closed loop in the vicinity of the heating coils and the inverter device.

9. A thawing device for railway track points, comprising:

a plurality of heating coils wound around floor plates for heating the floor plates by induction;

an inverter device for supplying high-frequency current to the heating coils;

a feeder cable for connecting the heating coils in series;

a supply and return connection cable for connecting the heating coils and the inverter device; and a protection against cable magnetism for preventing magnetic flux of the cables from leaking, wherein said protection against cable magnetism is constituted by superposing coils in which portions of the supply and return connection cables are wound respectively in the same direction, to the same diameter, and through the same number of turns.

10. A thawing device for railway track points, comprising:

a heating coil for heating a floor plate by induction; and an inverter device for supplying high-frequency current to the heating coil, wherein the heating coil is wound with a portion thereof being in contact with the upper face of the floor plate.

11. A thawing device for railway track points, comprising:

a heating coil for heating a floor plate by induction; and an inverter device for supplying high-frequency current to the heating coil, wherein the heating coil is wound through one or more turns in contact with the lower face of the floor plate and a portion thereof is wound in contact with the upper face of the floor plate.

* * * * *